US011142856B2

(12) United States Patent
Eklind

(10) Patent No.: US 11,142,856 B2
(45) Date of Patent: Oct. 12, 2021

(54) TREATMENT UNIT FOR IN-LINE TREATMENT OF THREAD

(71) Applicant: Coloreel Group AB, Jönköping (SE)

(72) Inventor: Martin Eklind, Jönköping (SE)

(73) Assignee: Coloreel Group AB, Jönköping (SE)

( * ) Notice: Subject to any disclaimer, the term of this patent is extended or adjusted under 35 U.S.C. 154(b) by 182 days.

(21) Appl. No.: 16/328,963

(22) PCT Filed: Aug. 25, 2017

(86) PCT No.: PCT/SE2017/050859
§ 371 (c)(1),
(2) Date: Feb. 27, 2019

(87) PCT Pub. No.: WO2018/044222
PCT Pub. Date: Mar. 8, 2018

(65) Prior Publication Data

US 2019/0194849 A1 Jun. 27, 2019

(30) Foreign Application Priority Data

Aug. 28, 2016 (SE) ..... 1651157-8

(51) Int. Cl.

| | |
|---|---|
| ***D05B 67/00*** | (2006.01) |
| ***D03J 1/04*** | (2006.01) |
| ***D05C 11/24*** | (2006.01) |
| ***D04B 15/00*** | (2006.01) |
| ***D04B 27/00*** | (2006.01) |
| ***D06P 5/30*** | (2006.01) |
| *D06B 11/00* | (2006.01) |

(52) U.S. Cl.
CPC ..... *D05B 67/00* (2013.01); *D03J 1/04* (2013.01); *D04B 15/00* (2013.01); *D04B 27/00* (2013.01); *D05C 11/24* (2013.01); *D06P 5/30* (2013.01); *D06B 11/0023* (2013.01)

(58) Field of Classification Search
CPC ..... D04B 15/00; D04B 27/00; D05B 67/00; D05C 11/24; D06P 5/30; D06B 11/0023; D03J 1/04
See application file for complete search history.

(56) References Cited

U.S. PATENT DOCUMENTS 1,929,192 A * 10/1933 William ..... D01D 10/0436 118/258
2,062,389 A * 12/1936 Bleibler ..... D06B 3/04 118/122

(Continued)

FOREIGN PATENT DOCUMENTS

CL 2018003254 A1 2/2019
CN 2490176 Y 5/2002

(Continued)

OTHER PUBLICATIONS

Extended European Search Report issued in corresponding EP Application No. 17847094.4, dated Mar. 25, 2020, pp. 1-8.

(Continued)

*Primary Examiner* — Benjamin L Osterhout
(74) *Attorney, Agent, or Firm* — Murtha Cullina LLP

(57) ABSTRACT

A treatment unit for in-line treatment of at least one thread for use with a thread consuming device is provided.

16 Claims, 5 Drawing Sheets

(56) References Cited

U.S. PATENT DOCUMENTS

| | | | | |
|---|---|---|---|---|
| 2,618,042 | A * | 11/1952 | Von Kohorn | D01D 10/0472 264/288.4 |
| 2,885,984 | A * | 5/1959 | Earnhart | D05B 67/00 112/281 |
| 6,189,989 | B1 | 2/2001 | Hirabayashi et al. | |
| 2003/0135931 | A1 | 7/2003 | Shaw | |
| 2005/0015177 | A1 | 1/2005 | Hagino et al. | |
| 2007/0033748 | A1 | 2/2007 | Arioglu et al. | |
| 2014/0349034 | A1 * | 11/2014 | Staberg | D05C 11/24 427/580 |

FOREIGN PATENT DOCUMENTS

| | | | |
|---|---|---|---|
| CN | 1443889 | A | 9/2003 |
| CN | 101765688 | A | 6/2010 |
| CN | 201809616 | U | 4/2011 |
| CN | 103541163 | A | 1/2014 |
| JP | 0770952 | A | 3/1995 |
| JP | 2003342867 | A | 12/2003 |
| JP | 2006299462 | A | 11/2006 |
| JP | 2009273675 | A | 11/2009 |
| KR | 100985471 | B1 | 10/2010 |
| WO | 0012804 | A1 | 3/2000 |
| WO | 0190461 | A1 | 11/2001 |
| WO | 02063094 | A1 | 8/2002 |
| WO | 2013039447 | A1 | 3/2013 |
| WO | 2017200473 | A1 | 11/2017 |

OTHER PUBLICATIONS

International Search Report issued in corresponding PCT Application No. PCT/SE2017/050859, dated Oct. 11, 2017, pp. 1-4.

Office Action from corresponding Korean Patent Application No. 10-2019-7008993, dated Apr. 22, 2021.

Office Action from corresponding Japanese Patent Application No. 2019-511721, dated Jun. 22, 2021.

* cited by examiner

TREATMENT UNIT FOR IN-LINE TREATMENT OF THREAD

TECHNICAL FIELD

The present invention relates to the technical field of thread consuming devices, such as embroidery machines. In particular the present invention relates to a treatment unit to be used in association with such thread consuming device.

BACKGROUND

It has been suggested to provide thread consuming devices, such as embroidery machines or the like, with in-line apparatuses designed to provide the thread with a certain treatment. Such in-line apparatuses could e.g. be used to color the thread, whereby multiple color nozzles could replace the current use of multiple pre-colored threads when producing multi-colored patterns using embroidery machines.

When a nozzle is arranged to color a thread passing by it is important to have an accurate alignment between the nozzle and the thread in use. However thread consuming devices, and especially embroidery machines, are usually subject to heavy vibrations during embroidery operation, especially due to the moveable stage carrying the fabric to be embroidered. It is therefore proven to be difficult to achieve the desired in-line treatment using existing thread consuming devices.

In view of this there is a need for an improved system for in-line treatment of thread, addressing the disadvantages mentioned above.

SUMMARY

An object of the present invention is to provide a treatment unit which can be used with existing thread consuming devices without incurring the problems mentioned above relating to reduced treatment quality.

According to a first aspect a treatment unit for use with a thread consuming device is provided. The treatment unit is configured to provide in-line treatment of at least one thread, and comprises a plurality of nozzles arranged at different positions relative the at least one thread, said at least one thread being in motion in use, each nozzle being configured to dispense one or more coating substances onto the at least one thread when activated, wherein said treatment unit is provided as a stand-alone unit.

The treatment unit may further comprise a first and second thread guiding device arranged at opposite sides of the nozzles in a direction corresponding to the thread feed direction.

The treatment unit may further comprise at least one support arrangement. The support arrangement is provided with means for attaching said treatment unit to an adjacent load-bearing structure.

In an embodiment, the support arrangement is adjustable such that the treatment unit is moveable relative said thread consuming device.

The treatment unit may further comprise a housing at least enclosing the plurality of nozzles.

The housing may form a protective cover for the entire treatment unit.

In an embodiment, the housing extends, at least partly, in a horizontal direction when arranged in connection with the thread consuming device such that the thread, when being fed through the treatment unit, is at least partly extending in a horizontal direction.

The housing may be L-shaped.

The treatment unit may further comprise at least one fixation device for fixating the one or more coating substances onto said thread.

In an embodiment, the treatment unit further comprises at least one thread feeding device.

The treatment unit may further comprise a control unit for at least controlling the operation of said plurality of nozzles.

In an embodiment the treatment unit further comprises a display configured to provide a graphical user interface.

The display may be configured to communicate with said control unit such that the operation of said plurality of nozzles may be controlled based on user input via said graphical user interface.

The display may be provided at an end portion of said treatment unit.

According to a second aspect, a thread consuming unit is provided. The thread consuming unit comprises a thread consuming device and at least one thread treatment unit according to the first aspect.

The at least one thread treatment unit may be arranged at least partly above said thread consuming device, or on said thread consuming device.

Definitions

Thread consuming device is in this context any apparatus which in use consumes thread. It may e.g. be an embroidery machine, weaving machine, sewing machine or knitting machine, or any other thread consuming apparatus which may benefit from a surface treatment or coating or any other process involving subjecting the thread to a substance, such as dying.

Stand-alone is in this context a term describing a relationship with associated operating equipment, i.e. the associated thread consuming device, meaning that there is no essential mechanical connection between a stand-alone device or unit and its surrounding operating equipment for allowing the desired functionality of the device or unit.

Housing is in this context any supporting structure which provides the necessary mounting means for its components comprised therein. Hence, a housing may not necessarily form a surrounding enclosure, but rather a support.

Treatment is in this context any process designed to cause a change of the properties of a thread. Such processes include, but are not limited to, coloring, wetting, lubrication, cleaning, fixing, heating, curing, etc.

Thread is in this context a flexible elongate member or substrate, being thin in width and height direction, and having a longitudinal extension being significantly greater than the longitudinal extension of any parts of the system described herein, as well as than its width and height dimensions. Typically, a thread may consist of a plurality of plies being bundled or twisted together. The term thread thus includes a yarn, wire, strand, filament, etc. made of various different materials such as glass fibre, wool, cotton, synthetic materials such as polymers, metals, or e.g. a mixture of wool, cotton, polymer, or metal.

Ply is in this context a flexible member forming part of a thread. A ply typically consists of several filaments being twisted together. For creating a balanced thread, i.e. a thread having no or very little kink, the plies and the filaments may in some cases be twisted in opposite direction.

Within this specification, all references to upstream and/or downstream should be interpreted as relative positions during normal operation of the thread consuming device, i.e. when the device is operating to treat an elongated substrate, such as a thread, continuously moving through the device in a normal operating direction. Hence, an upstream component is arranged such that a specific part of the thread passes it before it passes a downstream component.

BRIEF DESCRIPTION OF THE DRAWINGS

Embodiments of the invention will be described in the following description of the present invention; reference being made to the appended drawings which illustrate non-limiting examples of how the inventive concept can be reduced into practice.

DETAILED DESCRIPTION

Figure 1:
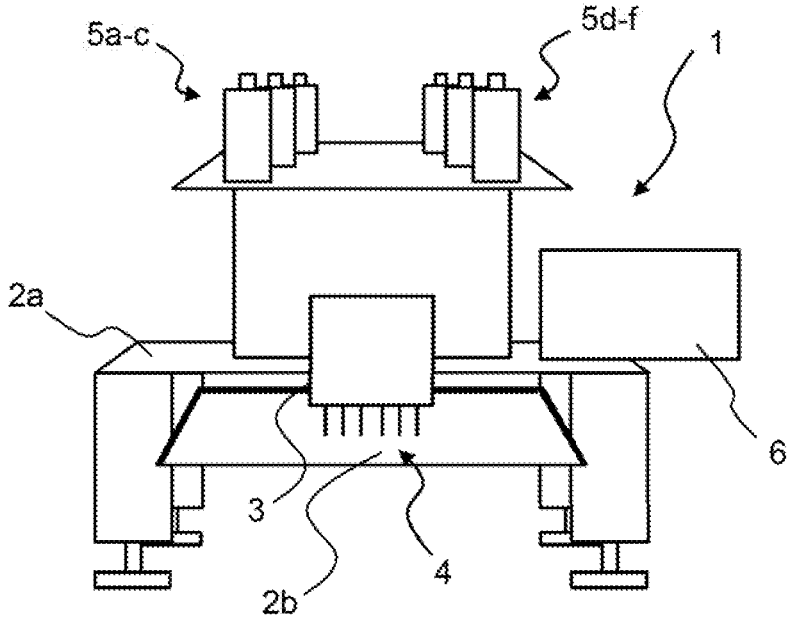
Fig. 1 Prior art
FIG. 1 is a schematic view of a single-head embroidery machine according to prior art.

Starting in FIG. 1 a single-head embroidery machine 1 according to prior art is schematically shown. The embroidery machine includes a rigid stand 2*a* onto which the active parts of the machine 1 is mounted, and a moveable stage 2*b* carrying the fabric to be embroidered. During operation the moveable stage 2*b* is controlled to rapidly change its position in the X and Y direction (i.e. the horizontal plane). The active parts are the moveable stage 2*b*, the embroidery head 3 and its associated needles 4, the threads 5*a-f*, and the control interface 6. The control interface 6 is formed as a display allowing an operator to control the operation of the embroidery machine 1 in terms of embroidery design, maintenance, etc. The threads 5 used for embroidery are provided as separate thread rells 5*a-f*, wherein each thread rell 5*a-f* carries thread of a unique color. Hence, controlling the operation of the embroidery machine 1 thus includes control of which color to be used, and consequently which thread reel to be used during embroidery.

The exact configuration of the embroidery machine 1 may vary depending on the manufacturer, but the underlying technology is well-known in the art and will not be described further herein.

Figure 2:
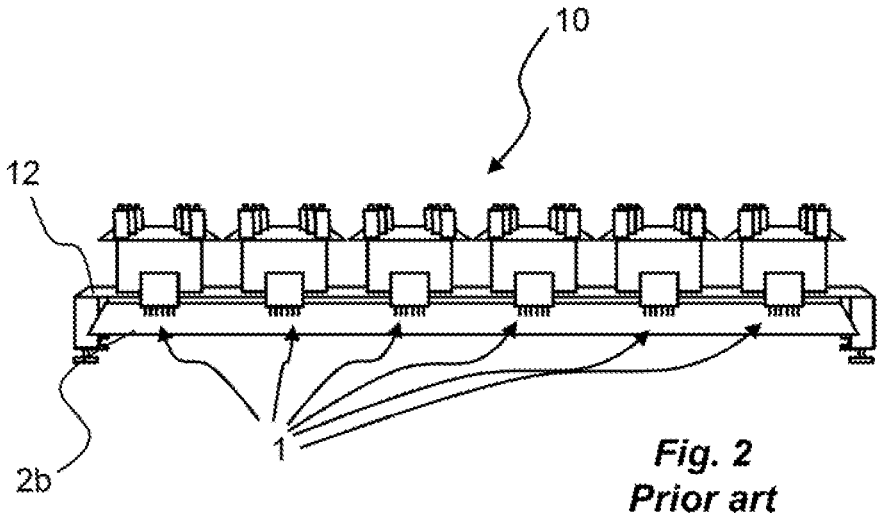
Fig. 2 Prior art
FIG. 2 is a schematic view of a multi-head embroidery machine according to prior art.

In FIG. 2 another example of an existing embroidery machine 10 is shown. The embroidery machine 10 of the example is a multi-head embroidery machine, meaning that several single-head embroidery machines 1 are connected by a single stage 12. During operation one or more of the single-head embroidery machines 1 may be running. The multi-head embroidery machine 10 is preferably associated with a common moveable stage 2*b*, as is indicated in FIG. 2.

Figure 3A:
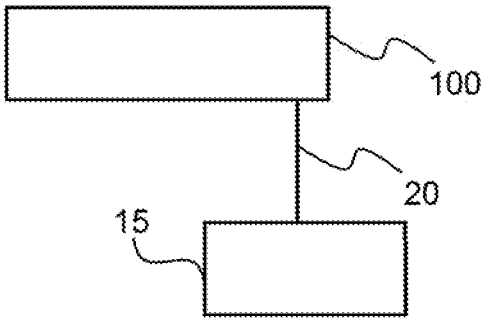
FIG. 3*a* is a schematic view of a thread consuming unit according to an embodiment.

In FIG. 3*a* a schematic view of a thread consuming unit is shown. The thread consuming unit comprises a thread consuming device 15, e.g. in the form of an embroidery machine, a weaving machine, a sewing machine, etc., and a treatment unit 100 as will be further described in the following.

Figure 3B:
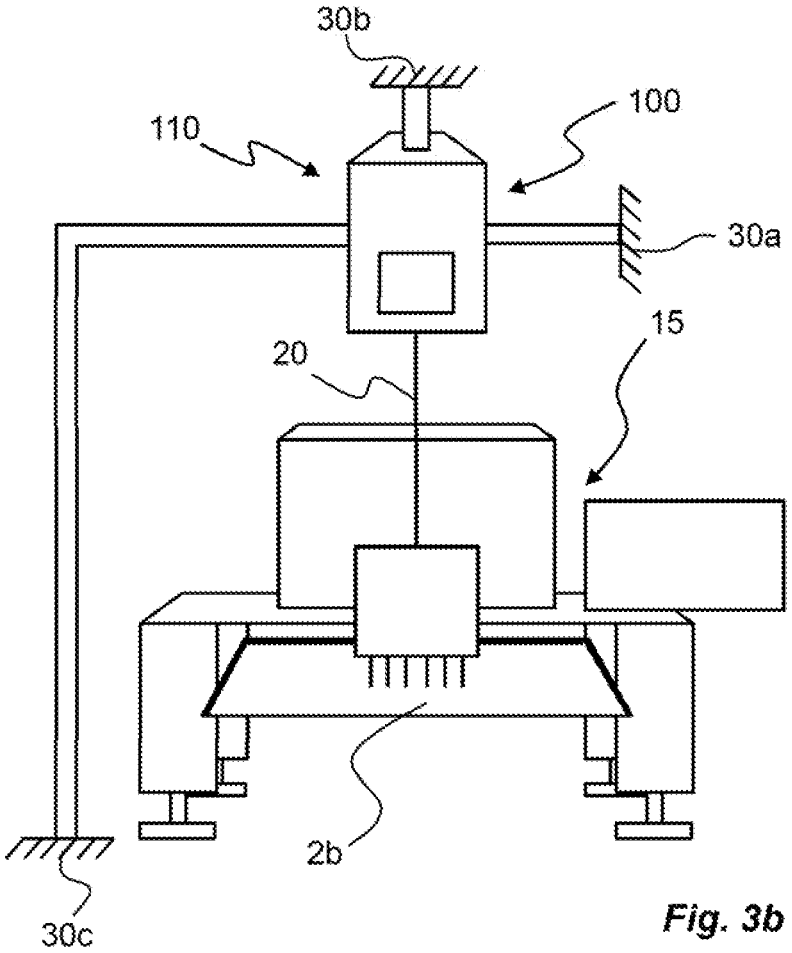
FIG. 3*b* is a schematic view of a thread consuming unit having a treatment unit according to an embodiment.

Now turning to FIG. 3*b* the thread consuming device 15 is exemplified as an embroidery machine 15, here illustrated as a single-head embroidery machine, being equipped with a treatment unit 100. The treatment unit 100 allows the embroidery machine 15 to operate without the provision of uniquely pre-colored threads, as is required for conventional embroidery machines. Instead, the treatment unit 100 provides in-line coloring of a thread 20 in accordance with predetermined coloring patterns, such that a colored embroidery can be produced. The treatment unit 100 thus replaces the individual thread reels 5*a-f* shown in FIGS. 1-2.

As is shown in FIG. 3*b* the only connection between the treatment unit 100 and the embroidery machine 15 is the thread 20, as well as electrical connections (not shown). The treatment unit 100 is thus provided as a stand-alone unit having no mechanical connection with the moveable stage 2*b*. Separate mounting for the treatment unit 100 can be achieved in a number of ways in order to prevent vibrations to be transmitted from the embroidery machine 15 to the treatment unit 100. In FIG. 3*b* three alternative mountings are shown. For all three alternatives the treatment unit 100 is provided with a support arrangement 110. The support arrangement 110 may e.g. be a beam or other rigid component designed to carry the weight of the entire treatment unit 100.

The support arrangement 110 is provided with attachment means (not shown), e.g. in the form of screws/bolts and associated bores, such that the support arrangement 110, and thus the entire treatment unit 100, may be attached to a load-bearing structure 30. The load bearing structure 30 may e.g. be a wall 30*a*, a ceiling 30*b*, or the underlying floor 30*c*. It should be noted that normally it is required to use only one load-bearing structure 30*a-c* to support the entire weight of the treatment unit 100. In an optional embodiment, the stand-alone treatment unit 100 is mounted to the thread consuming device 15 via a suspension arrangement for reducing the transmission of vibrations to the treatment unit 100.

During operation, the heavy vibrations of the embroidery machine 15 caused especially by the movement of the stage 2*b* will not be transmitted to the treatment unit 100 as this is provided as a stand-alone unit. Accurate coloring of the thread during operation is therefore possible.

Figure 4:
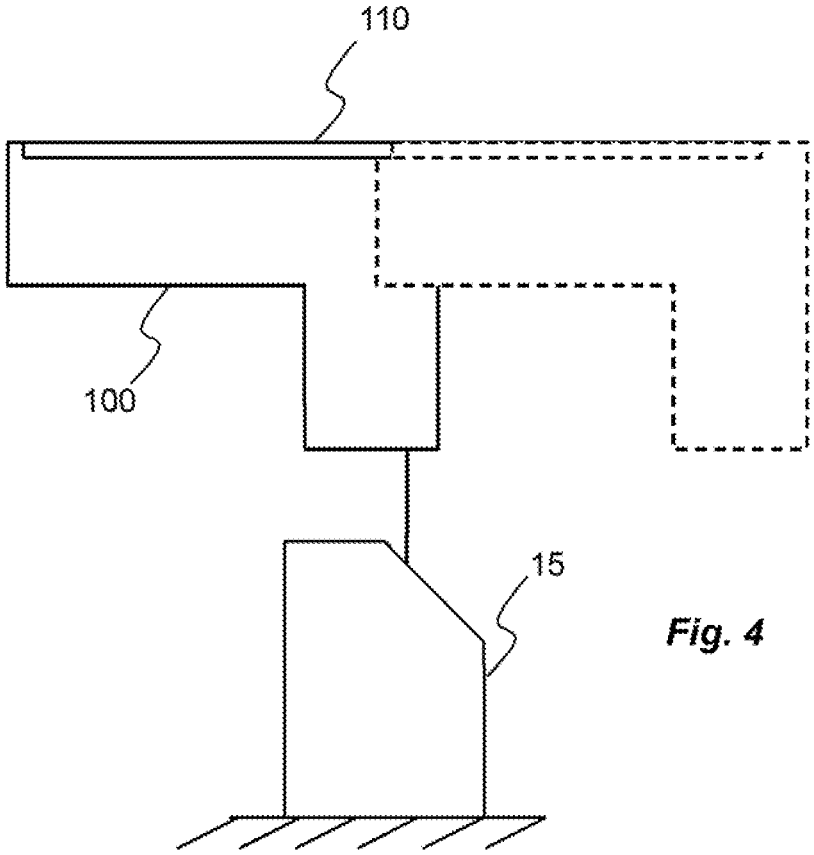
FIG. 4 is a side view of a treatment unit according to an embodiment.

In FIG. 4 a side view of an embodiment of the treatment unit 100 is shown. The support arrangement 110, here in the form of a beam extending along the treatment unit 100, is telescopic which means that the treatment unit 100 can be positioned either in an operation position, indicated by solid lines, or a service/maintenance position as is indicated by dashed lines. The telescopic functionality of the support arrangement 110 may e.g. be accomplished by having two beam members being slidably arranged relative each other. The support arrangement 110 may in other embodiments be pivotable, such that the treatment unit 100 may be rotated along a substantially vertical rotational axis.

The provision of a moveable support arrangement 110 is especially advantageous when multiple treatment units 100 are arranged in connection with a multi-head embroidery machine 15 as is shown in FIG. 2, as it would otherwise be difficult to access the treatment units 100 for service and/or maintenance.

Figure 5:
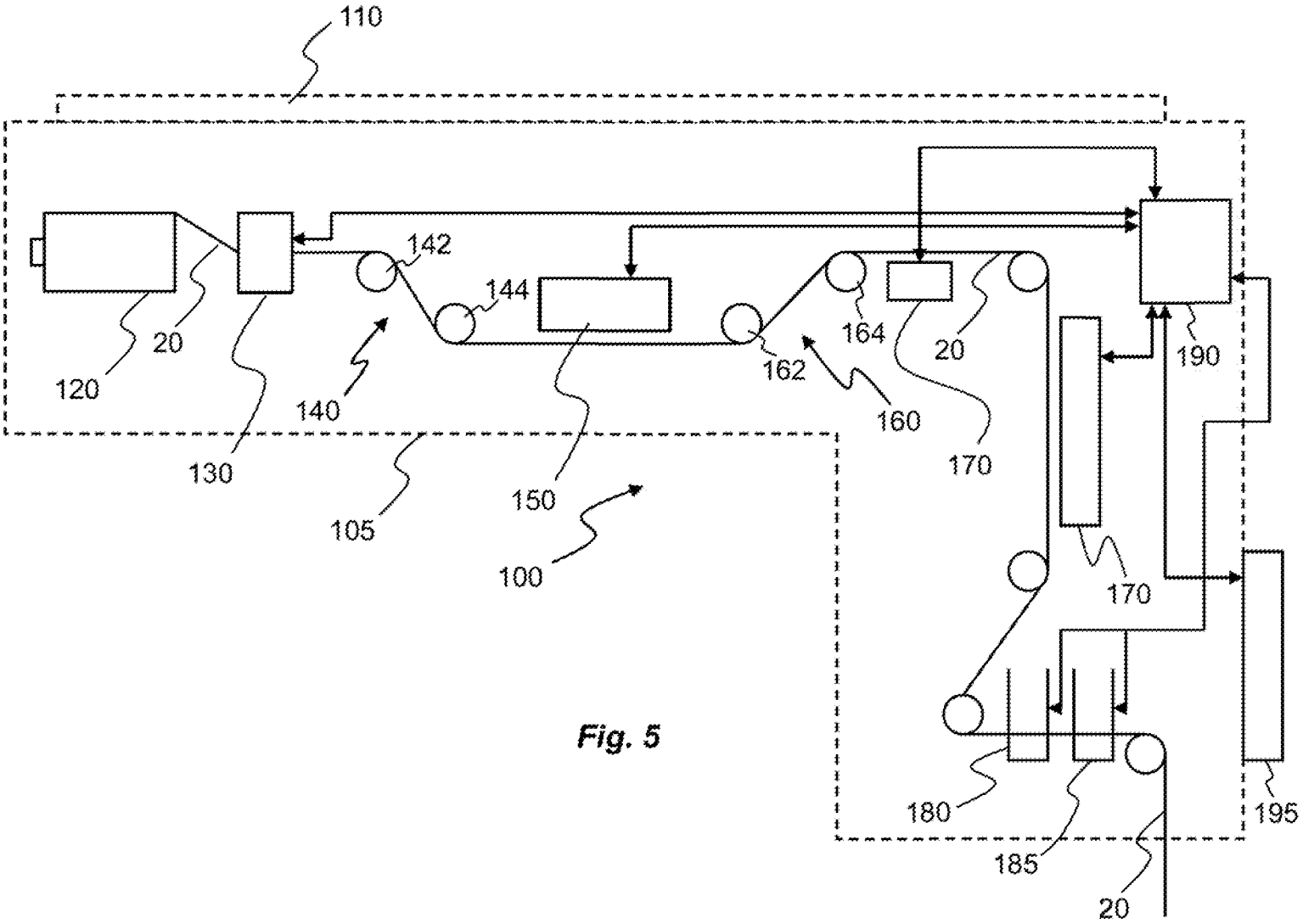
FIG. 5 is a schematic view of a treatment unit according to an embodiment.

The various components of the treatment unit 100 are shown in FIG. 5. As can be seen in FIG. 5 a majority of the components are arranged inside a housing 105, and the housing 105 is connected to the support arrangement 110 extending at the upper portion of the housing 105. The housing 105 extends from a front end, at which the treated thread 20 exits the treatment unit 100, to a rear end. The rear end of the housing 105 is preferably left open, or at least being openable, in order to load a thread reel 120. The thread reel 120 is preferably carrying an uncolored thread, or of any other standard color which is suitable for in-line coloring to various other colors and/or coloring effects.

The housing 105 may e.g. be a box-like enclosure in order to accommodate the various components of the treatment unit 100. The box-like enclosure may be formed by a metal sheet(s) being formed or assembled to form a closed space. The support arrangement 110 may not only be used to carry the weight of the treatment unit 100 and to allow for its support, but also for providing attachment means for the housing 105. The housing 105 may e.g. have a horizontal extension, a longitudinal extension, or a combination of a horizontal and a longitudinal extension. In FIG. 5, representing a preferred embodiment, the housing 105 has an L-shape. A horizontal part of the housing 105 encloses a first number of components, and a vertical part of the housing 105 encloses a second number of components. This particular design of the housing 105 has proven to provide a very efficient trade-off between two otherwise incompatible features, namely to provide a horizontally compact unit and to provide easy access to the interior components. Should a completely horizontally extending housing 105 be utilized its horizontal extension will be relatively big, whereby a vertically extending housing 105 will make it difficult to access the various components inside the housing 105.

Immediately downstream the thread reel 120 a thread feeder 130 may be arranged, which is configured to pull the thread forward through the treatment unit 100. The thread feeder 130 is not described further herein, but for a more general understanding the thread feeder 130 receives and forwards the thread 20. For this, the thread feeder 130 is controlled by a control unit 190 described further below. The thread feeder 130 is preferably also configured to control the thread tension, e.g. by means of a driven roller, an encoder wheel, and one or more thread guides. After passing the thread feeder 130 the thread 20 engages with a thread guiding device 140. The thread guiding device 140, which may e.g. be in the form of one or more guiding rollers 142, 144 or other suitable means, is ensuring that the thread 20 is aligned with one or more treatment nozzles forming part of discharge device 150. The discharge device 150 is configured to discharge treatment substance, such as a coloring substance, onto the thread 20 as it passes the discharge device 150. For this the nozzles are arranged preferably in the longitudinal direction of the thread 20 as will be further explained in relation to FIG. 6.

Downstream the discharge device 150 another thread guiding device 160 is provided. The second thread guiding device 160 is cooperating with the first thread guiding device 140 such that the position of the thread 20 is correct during its travel along the discharge device 150. The second thread guiding device 160 may e.g. be in the form of one or more guiding rollers 162, 164, although it may also be designed to induce a rotation of the thread 20 along its longitudinal axis. This extra functionality can provide advantages to the coloring as also will be described below.

The thread 20 is then fed forward to pass one or more fixation units 170 which are provided in order to fixate the treatment substance to the thread 20. The fixation unit 170 preferably comprises heating means, such as a hot air supply or heated elements, or an UV light source such that the treatment substance, e.g. a coloring substance, is cured or fixated onto the thread 20. As is shown in FIG. 5 the fixation unit 170 may either be arranged horizontally, vertically, or at an angle between horizontally and vertically.

Before exiting the housing 105 the thread 20 passes a cleaning unit 180, such as an ultrasonic bath, where unwanted particles are removed from the thread 20. As the treatment substance is fixated onto the thread 20, the cleaning unit 180 will leave the treatment substance unaffected.

The treatment unit 100 may further comprise a lubrication unit 185 arranged inside the housing 105. Additional thread buffers and feeders (not shown) may also be included in the treatment unit 100, arranged at various positions in the thread path.

The thread 20 preferably exits the treatment unit 100 through an aperture or similar, whereby the thread 20 is forwarded to an associated thread consuming device, such as an embroidery machine 15 as is shown in FIGS. 3*a-b*.

The thread feeder 130 and the other components engaging with the thread 20 during operation are preferably configured such that the force required to pull the thread 20 from the treatment unit 100, i.e. the pulling force applied by the downstream embroidery machine 15, is approximately the same as if the treatment unit 100 was replaced by prior art thread reels.

A control unit 190 with associated electronics, such as power electronics, communication modules, memories, etc. is also provided. The control unit 190 is connected to the thread feeder 130, the discharge device 150, and the fixation unit 170 for allowing control of the operation of these components. Further, the control unit 190 is configured to controlling operation of the entire treatment unit 100 including the cleaning unit 180, the lubrication unit 185, a disruption of the thread 20, the thread speed at various position along the treatment unit 100, the thread buffers, etc. The control unit 190 may also be configured to receive control signals from one or more components of the treatment unit 100, e.g. control signals for triggering specific control, or other information relating to e.g. thread consumption by the embroidery machine 15.

A user interface is also provided, preferably via a display 195 arranged at the front end of the housing 105. The display 195 allows a user to interact with the control unit 190 and is thus connected thereto, so that the control parameters of the thread feeder 130, the discharge device 150, the fixation unit 170, etc. may be set depending on process specifications. The display 195 may also preferably be used for alerting the user of critical situations, whereby the display 195 may be used for the control unit 190 to issue alarms or the like.

It should be noted that the components described above may not necessarily be included in the stand-alone treatment unit 100, but instead the components of the treatment unit 100 may be separated into several units, of which at least one unit is a stand-alone unit. Preferably, the stand-alone unit includes at least the discharge device 150 and the adjacent thread guiding devices 140, 160.

Figure 6:
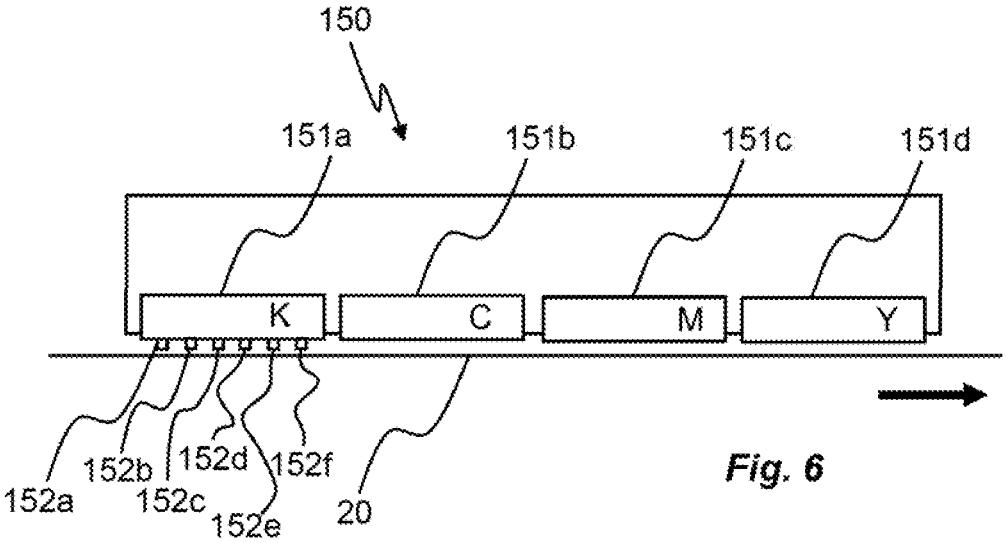
FIG. 6 is a schematic view of a nozzle head for use with a treatment unit according to an embodiment.

Examples of the discharge device 150 will be further described with reference to FIG. 6. In FIG. 6 an embodiment is shown in which the discharge device 150 is formed as an ink-jet nozzle head having multiple nozzle arrays 151*a-d*. Each nozzle array 151*a-d* may for example be an inkjet nozzle array, comprising thousands of nozzles. For illustrative purpose only six nozzles 1525*a-f* are shown for one nozzle array 151*a*; it should however be realized that each nozzle array 151*a-d* may be provided with thousands of nozzles 152 each. As an example, each nozzle array 151*a-d* may be associated with a single color, illustrated according to the CMYK standard. However, other coloring models may be used as well. It may also be possible to arrange the nozzle arrays 151*a-d* as separate units within the treatment unit 100.

In this embodiment each nozzle 152*a-f* dispenses a coating substance having a color according to the CMYK color model, where the primary colors are Cyan, Magenta, Yellow, and Black. It may thus be possible to dispense a wide variety of colors onto the thread by activating nozzles 152*a-f* such that the total coloring substance of a specific length of the thread 20 will be a mix of the coloring substances dispensed by the nozzles 152*a-f*. In another embodiment, each nozzle 152*a-f* dispenses a coating substance having a color comprising a mix of two or more primary colors of the CMYK color model.

The control unit 190 is configured to control the activation of the nozzles 152*a-f* such as the coating substance is emitted onto the thread 20 as it passes through the treatment unit 100. By such configuration e.g. very precise coloring of the thread 20 is possible e.g. in order to provide advanced embroidery patterns, visually extremely sophisticated by means of the coloring provided by the treatment unit 100. Although the present invention has been described above with reference to specific embodiments, it is not intended to be limited to the specific form set forth herein. Rather, the invention is limited only by the accompanying claims.

In the claims, the term "comprises/comprising" does not exclude the presence of other elements or steps. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second" etc do not preclude a plurality. Reference signs in the claims are provided merely as a clarifying example and shall not be construed as limiting the scope of the claims in any way.

What is claimed is:

1. A treatment unit for in-line treatment of at least one thread for use with a thread consuming device, said treatment unit comprising a plurality of nozzles arranged at different positions relative to the at least one thread, said at least one thread being in motion in use, each nozzle being configured to dispense one or more coating substances onto the at least one thread when activated, wherein said treatment unit is provided as a stand-alone unit, at least one support arrangement, wherein said support arrangement is configured to be attached to an adjacent load-bearing structure.

2. The treatment unit according to claim 1, further comprising a first and second thread guiding device arranged at opposite sides of the nozzles in a direction corresponding to the thread feed direction.

3. The treatment unit according to claim 1, wherein said support arrangement is adjustable such that the treatment unit is moveable relative said thread consuming device.

4. The treatment unit according to claim 1, further comprising a housing at least enclosing the plurality of nozzles.

5. The treatment unit according to claim 4, wherein said housing forms a protective cover for the entire treatment unit.

6. The treatment unit according to claim 4, wherein said housing extends, at least partly, in a horizontal direction when arranged in connection with the thread consuming device such that the thread, when being fed through the treatment unit, is at least partly extending in a horizontal direction.

7. The treatment unit according to claim 4, wherein said housing is L-shaped.

8. The treatment unit according to claim 1, further comprising at least one fixation device for fixating the one or more coating substances onto said thread.

9. The treatment unit according to claim 1, further comprising at least one thread feeding device.

10. The treatment unit according to claim 1, further comprising a control unit for at least controlling the operation of said plurality of nozzles.

11. The treatment unit according to claim 10, further comprising a display configured to provide a graphical user interface.

12. The treatment unit according to claim 11, wherein said display is configured to communicate with said control unit such that the operation of said plurality of nozzles may be controlled based on user input via said graphical user interface.

13. The treatment unit according to claim 11, wherein said display is provided at an end portion of said treatment unit.

14. A thread consuming unit, comprising a thread consuming device and at least one thread treatment unit according to claim 1.

15. The thread consuming unit according to claim 14, wherein said at least one thread treatment unit is arranged at least partly above said thread consuming device.

16. The thread consuming unit according to claim 14, wherein said at least one thread treatment unit is arranged on said thread consuming device.

* * * * *